US007001232B2

(12) United States Patent
Montgomery

(10) Patent No.: US 7,001,232 B2
(45) Date of Patent: Feb. 21, 2006

(54) PERSONAL WATERCRAFT AIR INTAKE ASSEMBLY

(76) Inventor: Robert E. Montgomery, 1000 Calle Amanecer, San Clemente, CA (US) 92673

( * ) Notice: Subject to any disclaimer, the term of this patent is extended or adjusted under 35 U.S.C. 154(b) by 0 days.

(21) Appl. No.: 11/010,635

(22) Filed: Dec. 13, 2004

(65) Prior Publication Data

US 2005/0239352 A1 Oct. 27, 2005

Related U.S. Application Data

(60) Provisional application No. 60/528,741, filed on Dec. 11, 2003.

(51) Int. Cl.
*B63H 21/10* (2006.01)

(52) U.S. Cl. ..... 440/88 A; 114/55.56

(58) Field of Classification Search ..... 440/88 A; 114/55.5, 55.56, 211; 441/74
See application file for complete search history.

(56) References Cited

U.S. PATENT DOCUMENTS 1,712,620 A * 5/1929 Ocean ..... 440/88 A
3,262,413 A * 7/1966 Douglas et al. ..... 440/88 A
3,548,778 A * 12/1970 Von Smagala-Romanoff ..... 440/88 A
3,890,920 A * 6/1975 Buelk ..... 440/71
5,582,529 A * 12/1996 Montgomery ..... 441/74
6,192,817 B1 * 2/2001 Dec et al. ..... 114/55.56
6,568,340 B1 * 5/2003 Dec et al. ..... 114/55.56

* cited by examiner

*Primary Examiner*—Lars A. Olson
(74) *Attorney, Agent, or Firm*—Lynn & Lynn

(57) ABSTRACT

An air intake assembly for a personal watercraft provides air to an internal combustion engine located within a hull cavity includes a housing having a generally horn-shaped configuration that includes a base and an outer end. The housing has an air passage that extends from a base to an outer end. An adaptor assembly connects the base to the hull and is arranged to form a seal around an opening in an upper portion of the hull. The adaptor assembly includes an opening aligned with the air passage. An air intake valve assembly is mounted in the opening with the valve assembly being arranged to be open to allow air flow into the hull when the upper portion of the housing points upward from a horizontal plane through the upper portion of the hull and being further arranged to close whenever the outer end of the housing has a downward pointing component.

1 Claim, 9 Drawing Sheets

EXPLD STATE; BOARDBLOWN(+)
AIR INTAKE
AIR
WATER
25
26
28
30
32
34
36
38
40
42
44
46
48
50
52
54
56
58

PERSONAL WATERCRAFT AIR INTAKE ASSEMBLY

CROSS REFERENCE TO RELATED APPLICATION

Applicant claims priority based on his provisional patent application No. 60/528,741, filed Dec. 11, 2003.

BACKGROUND OF THE INVENTION

This invention relates generally to personal watercraft and particularly to a personal watercraft that is powered by an internal combustion engine. More particularly, this invention relates to apparatus for providing air to the engine while preventing water from entering the engine.

It is essential that water be prevented from entering the engine and mixing with the fuel/air mixture that is required for operation of an internal combustion engine. The very nature of such watercraft is that water often washes over or splashes onto the watercraft's hull. Occasionally a personal watercraft will flip over so that the entire deck portion and the air intake are submerged in water.

SUMMARY OF THE INVENTION

This invention overcomes problems with water entering the air intake of a personal watercraft so that it can operate in a high performance mode without having the engine stall or become damaged because of taking water into the intake manifold.

An air intake assembly according to the invention for providing air to an internal combustion engine located within a personal watercraft hull comprises a housing having a generally horn-shaped configuration that includes a base and an outer end, the housing having an air passage that extends from the base to the outer end. An adaptor assembly connects the base of the housing to the hull and is arranged to form a seal around an opening in an upper portion of the hull. The adaptor assembly includes an opening arranged to be aligned with the air passage. An air intake valve assembly is mounted in the opening with the valve assembly being arranged to be open to allow air flow into the hull when the upper portion of the housing points upward from a horizontal plane through the upper portion of the hull and being further arranged to close whenever the outer end of the housing has a downward pointing component.

The invention may also include a passage that directs any water that enters the housing away from the air passage and the air intake valve assembly

DETAILED DESCRIPTION OF THE INVENTION

Figure 1:
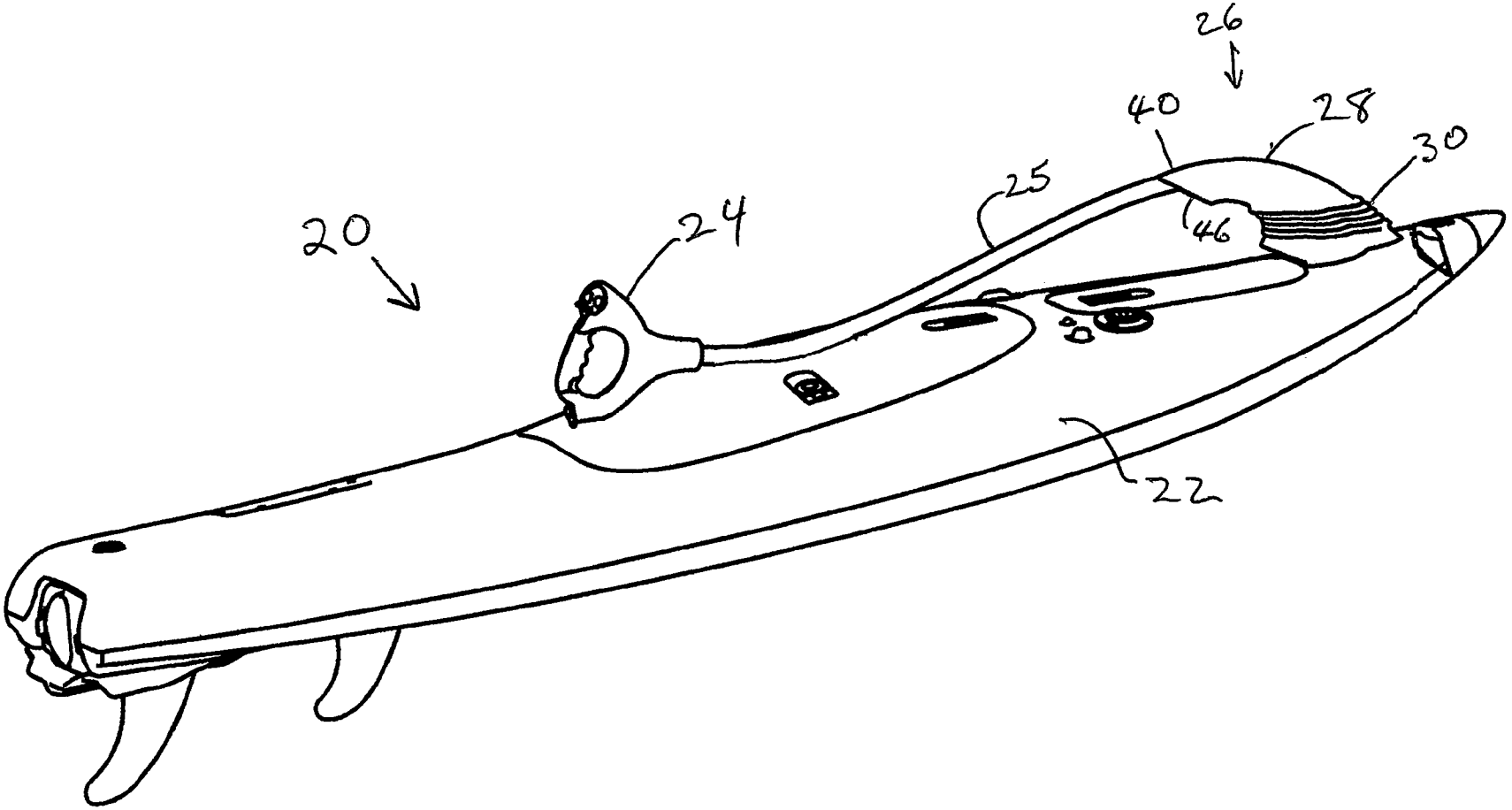
FIG. 1 is a simplified perspective view of a personal watercraft showing an arm pole connected to the watercraft hull by an air intake assembly according to the invention.
Figure 2:
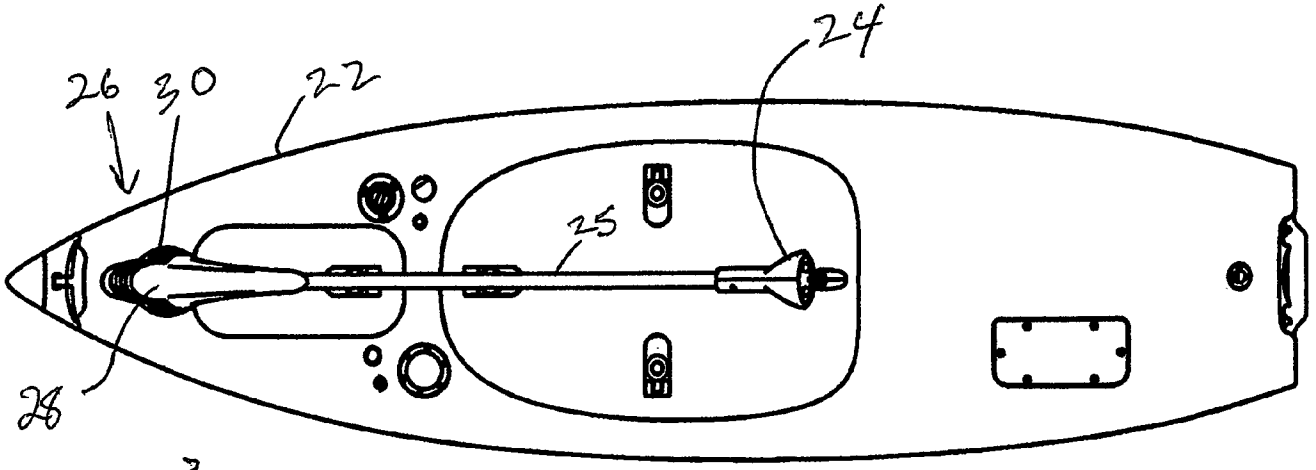
FIG. 2 is a top plan view of the apparatus of FIG. 1.

As shown in FIGS. 1–4, a personalized watercraft 20 includes a hull 22 with an engine (not shown), an exhaust system (not shown) and a fuel tank (not shown). A person using the personalized watercraft 20 typically stands near its center and controls it by means of a control handle 24. The operating handle 24 is connected to the hull 22 by means of an arm pole 25 that is connected to an air intake assembly 26.

Figure 4:
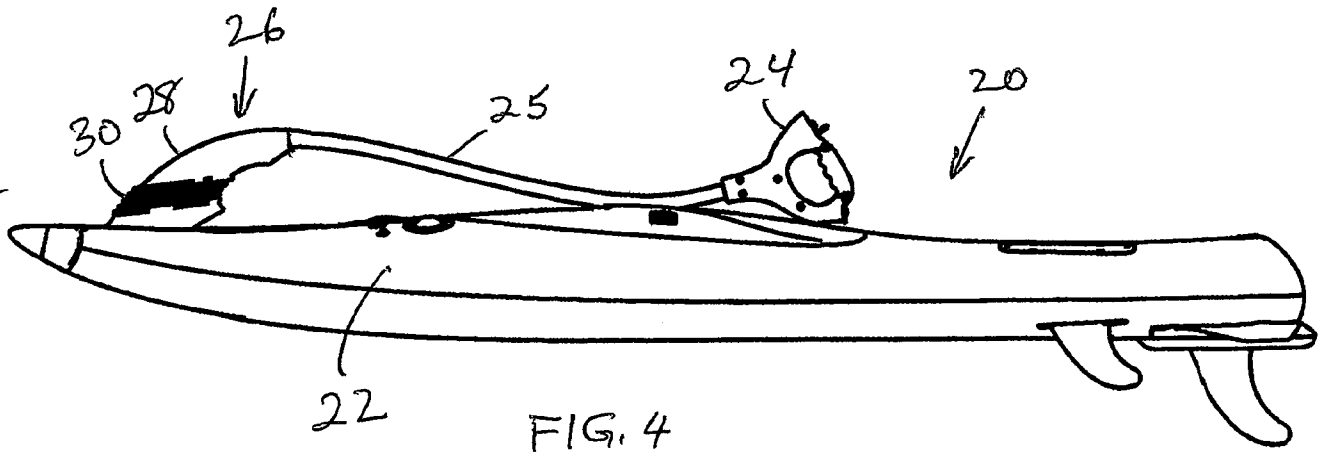
FIG. 4 is side elevation view of the apparatus of FIG. 1.
Figure 3:
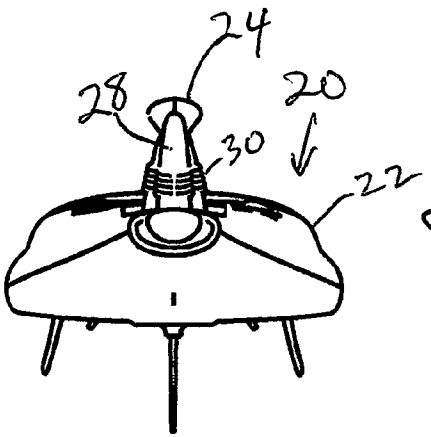
FIG. 3 is a front elevation view of the apparatus of FIG. 1.
Figure 5:
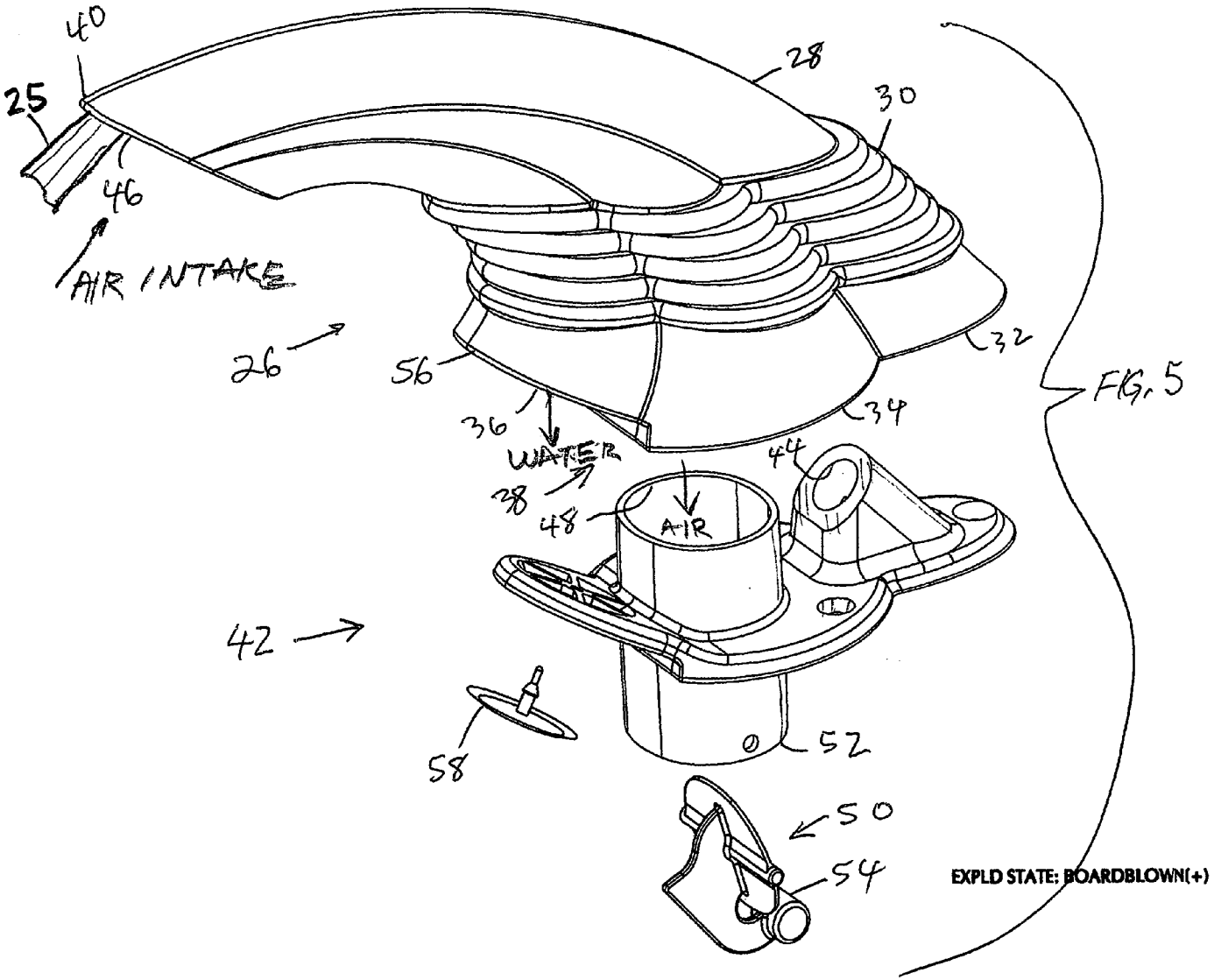
FIG. 5 is an exploded perspective view of an air intake assembly according to the invention showing an air intake housing, a water outlet valve, an air intake valve and a control conduit.
Figure 7:
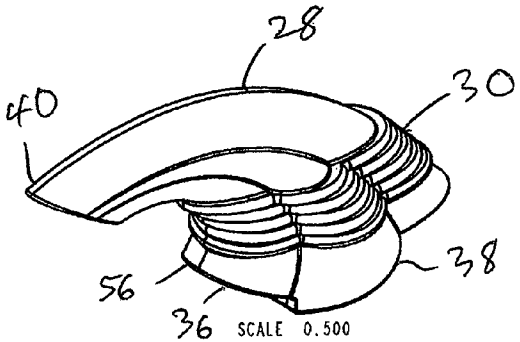
FIG. 7 is a perspective view of the air intake assembly according to the invention.
Figure 9:
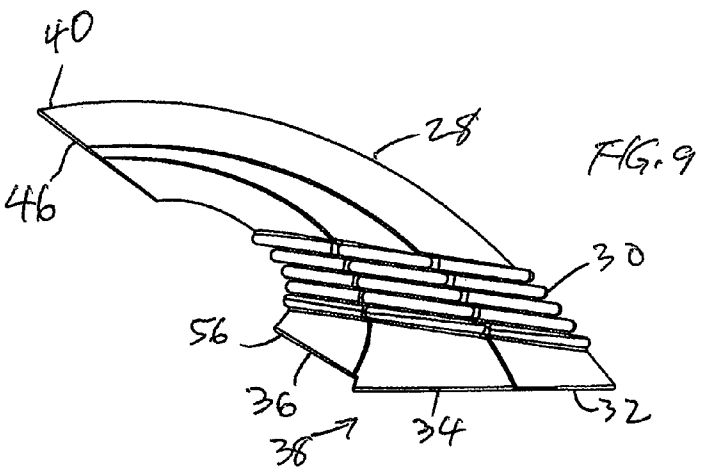
FIG. 9 is a side elevation view of the air intake assembly according to the invention.
Figure 6:
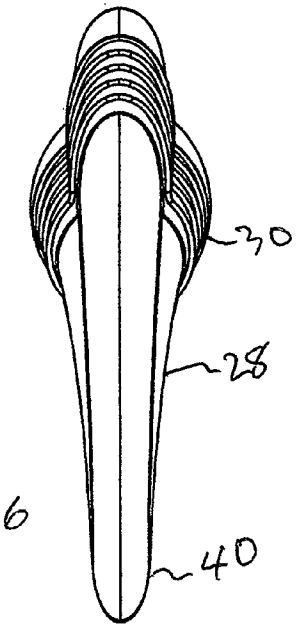
FIG. 6 is a top plan view of the air intake housing assembly according to the invention.
Figure 8:
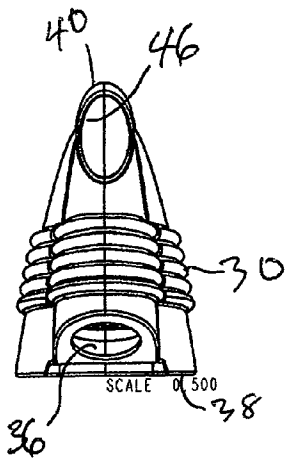
FIG. 8 is a rear elevation view of the air intake assembly according to the invention

As shown in FIGS. 4 and 5, the air intake assembly 26 includes a housing 28 that is preferably formed in a generally horn-shaped configuration. The housing 28 may be formed of a somewhat flexible material and that preferably has a ribbed central section 30 to provide additional flexibility. The air intake assembly 26 preferably includes three conduits 32, 34 and 36 that extend from a base portion 38 of the housing 28 to an upper portion 40.

Figure 10:
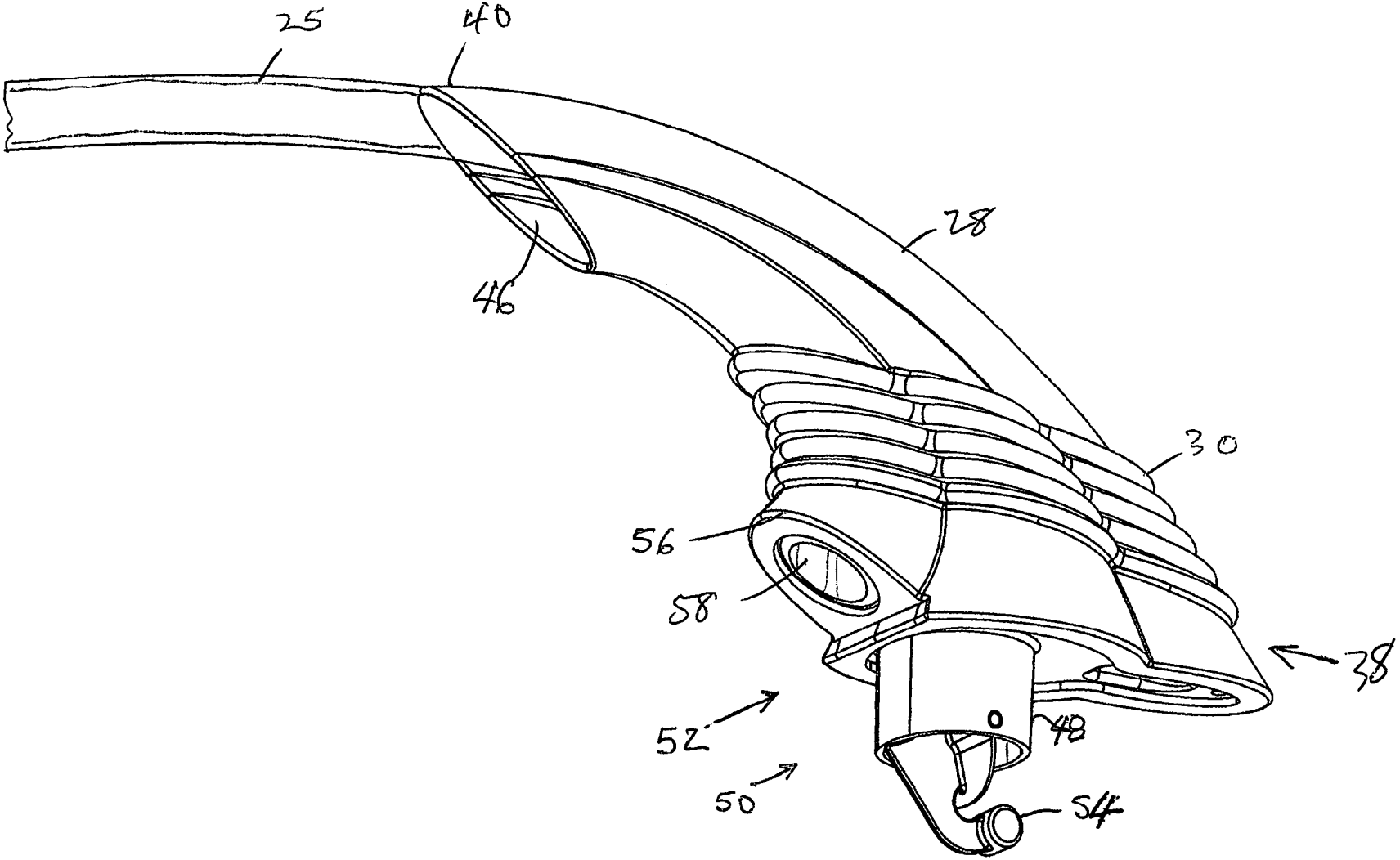
FIG. 10 is an enlarged perspective view of the air intake assembly according to the invention showing an arm pole outlet, a water outlet and an air intake valve.
Figure 11:
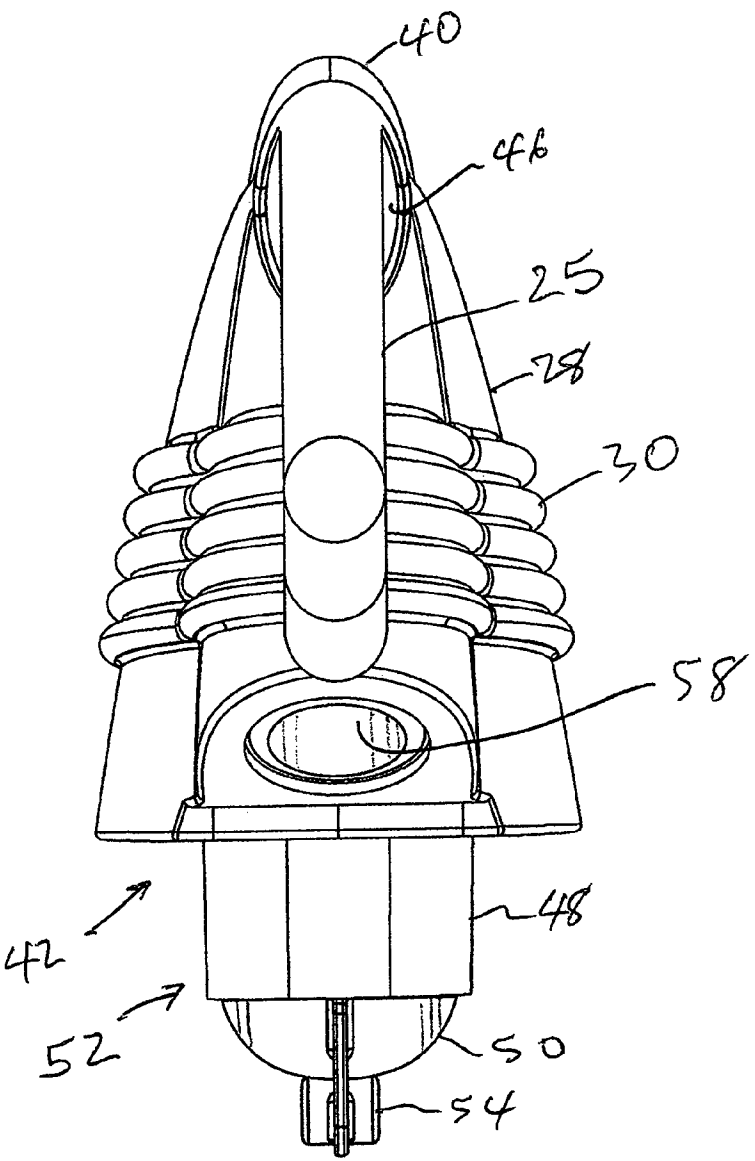
FIG. 11 is an enlarged rear elevation view of the according to the invention assembly according to the invention assembly according to the invention showing the water outlet and the air intake valve.
Figure 12:
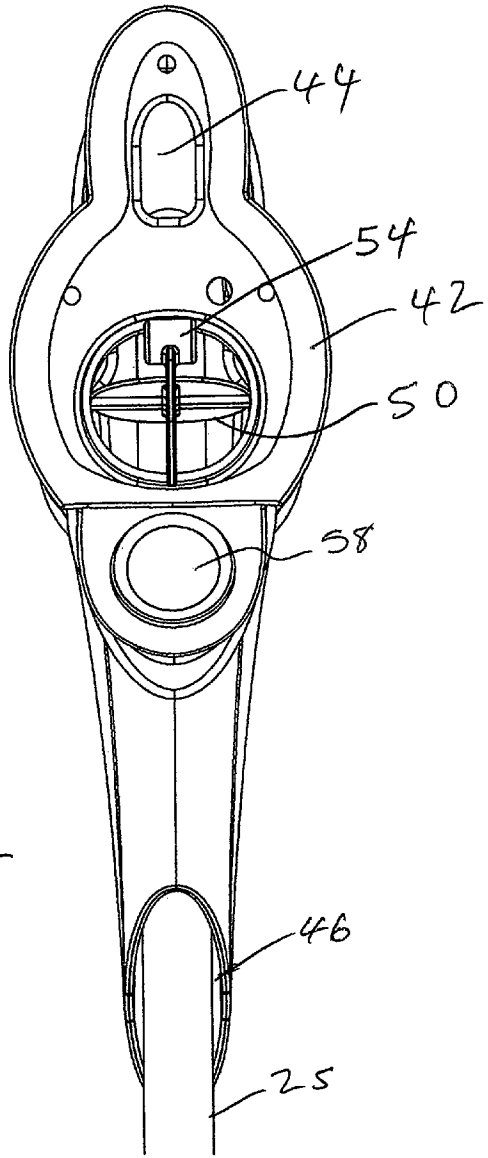
FIG. 12 is a bottom plan view of the according to the invention assembly according to the invention showing the water outlet and the air intake valve.
Figure 13:
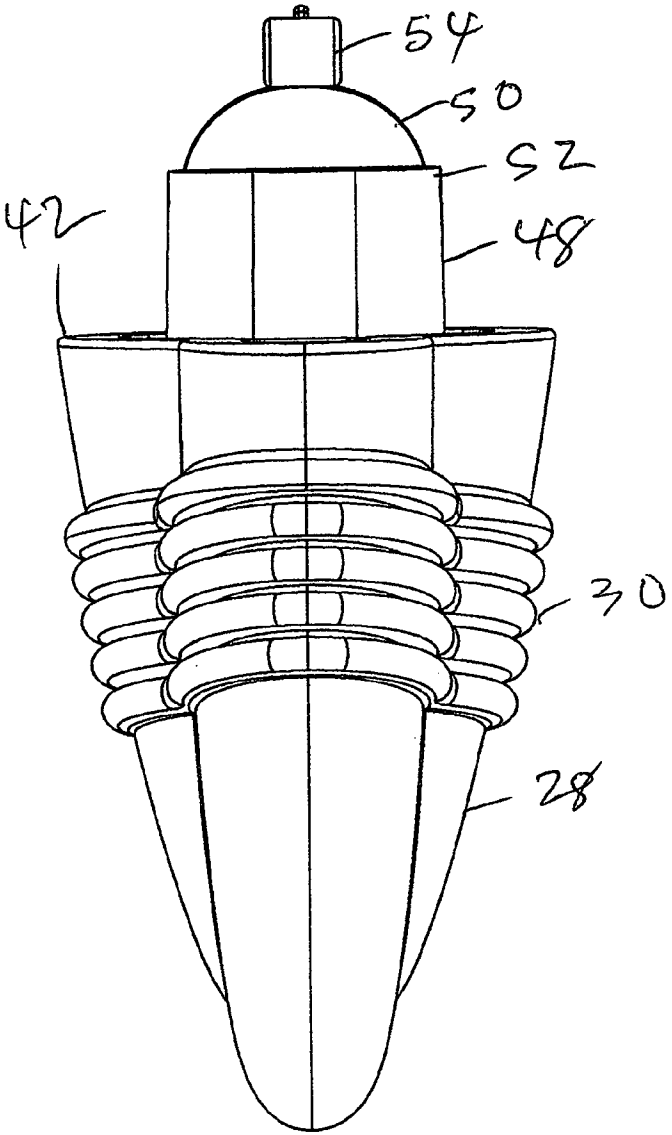
FIG. 13 is a front elevation view of the according to the invention assembly according to the invention showing the air intake valve.
Figure 14:
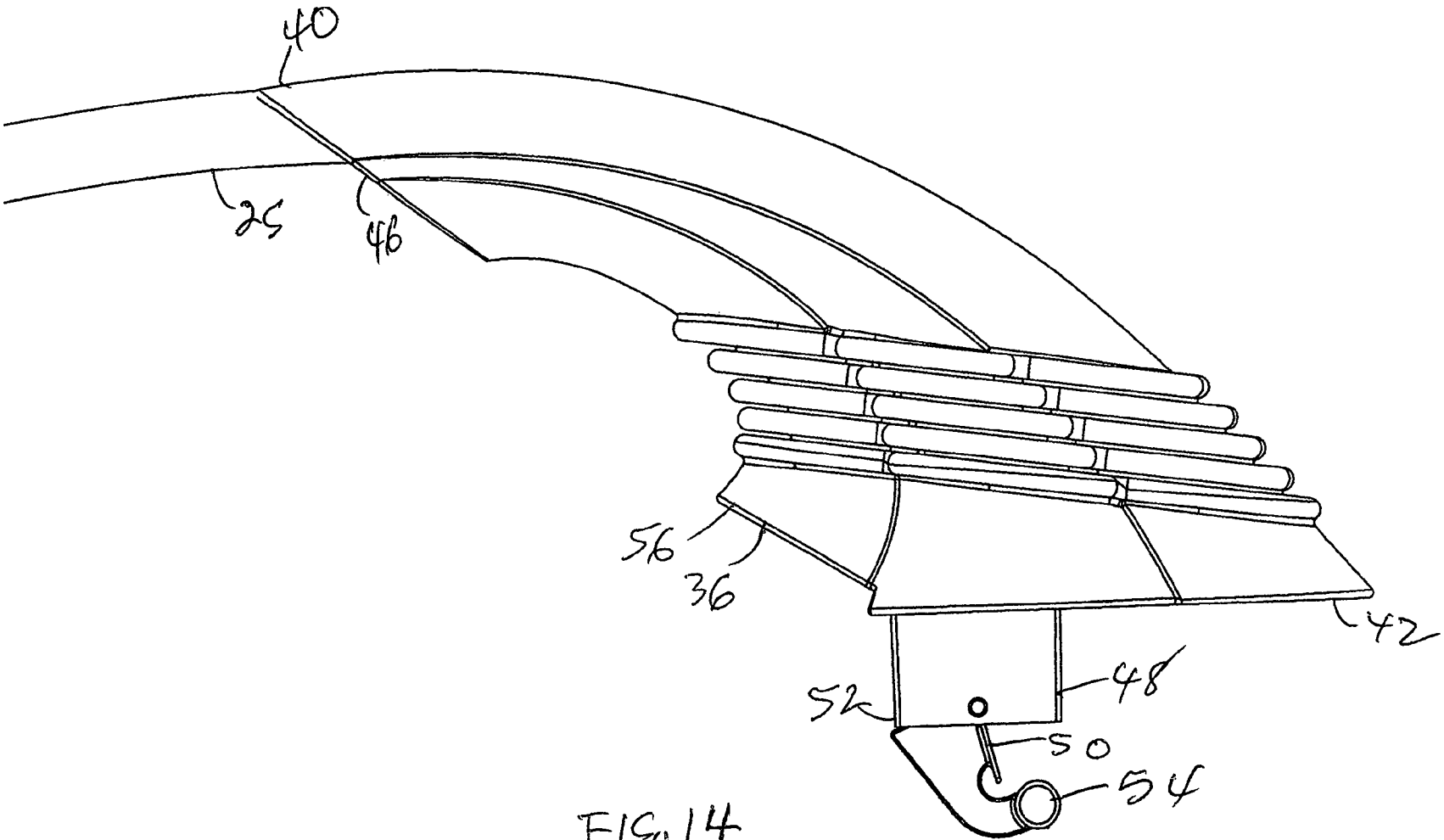
FIG. 14 is an enlarged side elevation view of the according to the invention assembly according to the invention showing the air intake valve.

The air intake assembly 26 also includes an adaptor assembly 42 that is used to connect the housing 28 to the hull 22. As shown in FIGS. 10–12, the arm pole 25 passes through the conduit 32 and is mounted in a hole 44 in the adaptor assembly 42. Apparatus (not shown) for carrying control signals from the operating handle 24 to the engine passes through the arm pole 25 and the hole 44 to the engine.

As shown in FIGS. 5 and 8–10, air required for operation of the engine passes around the arm pole 25 through an opening 46 in the upper portion 40 of the housing 28 down through the conduit 34 to a conduit 48 in the adaptor assembly 42 for delivery to the engine. As shown in FIGS. 5, 10, 11, 13 and 14, a valve assembly 50 is mounted in a lower portion 52 of the conduit 34. The valve 50 is pivotally mounted and has a counterweight 54 that keeps the valve 50 in an open position to allow airflow into the engine when the hull is topside up. The counterweight 54 is arranged to be off-center with respect to the pivot so that whenever the hull 22 turns over so that it is topside down, the valve 50 closes to prevent water from being sucked into the engine.

It is possible during normal operation of the watercraft 20 that a small amount of water will enter the opening 46 around the arm pole. The curved configuration of the housing 28 causes any such water to fall below the air conduit 34 into a water conduit 36. The water then passes through the water conduit 36 to its lower end 56, which is connected to the adaptor assembly 42. The weight of the water opens a diaphragm 58 that is mounted in the adaptor assembly 42 and then flows out of the housing 28. If the hull 22 should be turned over in the water so that the diaphragm 58 is submerged, the water pressure urges the diaphragm 58 toward the adaptor assembly 42 to form a seal that prevents water flow into the housing.

What is claimed is:

1. An air intake assembly for providing air to an internal combustion engine located within a personal watercraft hull, comprising:

a housing having a generally horn-shaped configuration that includes a base and an outer end, the housing having an air passage that extends from the base to the outer end;

an adaptor assembly formed to connect the base of the housing to the hull and arranged to form a seal around an opening in an upper portion of the hull, the adaptor assembly including an opening arranged to be aligned with the air passage;

a valve assembly mounted in the opening, the valve assembly being arranged to be open to allow air flow into the hull when the outer end of the housing points upward from a horizontal plane through the upper portion of the hull and being further arranged to close whenever the outer end of the housing has a downward pointing component.

* * * * *